United States Patent [19]

Göttling

[11] 4,207,803

[45] Jun. 17, 1980

[54] STOPPING DEVICE FOR DOUBLE-ACTING, PNEUMATIC OPERATING CYLINDERS

[75] Inventor: Helmut Göttling, Oberweser, Fed. Rep. of Germany

[73] Assignee: WABCO Westinghouse GmbH, Hanover, Fed. Rep. of Germany

[21] Appl. No.: 873,339

[22] Filed: Jan. 30, 1978

[30] Foreign Application Priority Data

Feb. 21, 1977 [DE] Fed. Rep. of Germany ..... 2707419

[51] Int. Cl.[2] ..... F15B 13/16; F15B 12/044

[52] U.S. Cl. ..... 91/410; 91/358 R; 91/459

[58] Field of Search ..... 91/331, 332, 279, 410, 91/358 R

[56] References Cited

U.S. PATENT DOCUMENTS

| | | | |
|---|---|---|---|
| 2,286,026 | 6/1942 | Towler et al. | 91/279 |
| 3,042,326 | 7/1962 | Lamb et al. | 91/279 |
| 3,720,137 | 3/1973 | Landherr | 91/279 |

*Primary Examiner*—Paul E. Maslousky

*Attorney, Agent, or Firm*—R. S. Visk; R. W. McIntire, Jr.

[57] ABSTRACT

The invention relates to a positioner device for positioning the piston and piston rod of a double-acting, pneumatic operating cylinder at a preselected position for setting the position of a device connected thereto, such as the lever of a throttle valve, for example, with the positioner device having a locking device connected to the piston rod which can be controlled by a control valve for securing and maintaining the piston and rod in the selected position, without variance, until deliberately changed.

6 Claims, 4 Drawing Figures

STOPPING DEVICE FOR DOUBLE-ACTING, PNEUMATIC OPERATING CYLINDERS

BACKGROUND OF THE INVENTION

In this type of positioner device, it is necessary to retain a piston rod, which has to perform certain functions in machines, devices and control systems of industrial installations, in a selected position, as desired, according to circumstances without the use of fixed stops.

In order to meet these requirements, certain pneumatic operating cylinders with stroke adjustment are known wherein the piston is attempted to be held in a particular stroke position in that the two sides of the piston of the operating cylinder are acted upon simultaneously by opposing air pressures. However, this kind of control for operating cylinders of the above type has the disadvantage that it is not possible to predetermine an accurate holding position of the piston, i.e., the piston always moves to an undetermined holding position which deviates from the position or holding position desired, particularly when there are leaky lines.

As is also known, a stroke adjustment in a double-action, pneumatic operating cylinder can be obtained by means of adjustable stops which act directly upon stem ends of a reversing valve in the form of a two-way valve, in which case the stops execute a movement in synchronism with the piston or piston rod, and the reversing valve is mounted on the cylinder and thus connected therewith in such a manner that the control element of the reversing valve and the piston or piston rod can be displaced in an opposite direction relative to each other. When making use of simple, fixed stops, in particular in larger equipment, there would not only occur much noise but also the control devices would be subjected to forceful impacts, which would further lead to early destruction of individual components.

In the case of braking devices which have to absorb the full piston power, it is further a great disadvantage that when the piston is set in motion again, this happens abruptly. Moreover, with these devices there is a high surface pressure on the piston rod, which leads to move rapid wear and tear.

SUMMARY OF THE INVENTION

The object of the invention is to stop, without the occurrence of forceful jerks, the piston rod in its movement during the operation from any momentary operating position to any desired holding position, in such a manner that the holding position required of the piston is reached with accuracy and then maintained in such position without variance.

This object is attained, according to the invention, in that a reversing valve in the form of a, three-position, valve having a blocking or closing portion is fixedly connected to a locking device by means of an actuating stem, in which case the locking device encloses, in a sliding relation, a piston rod of a positioner device and can be controlled via a compressed-air connection especially provided for this purpose in such a manner that it is possible to provide, in the direction of axial movement, a coupling between the piston rod and the locking device and thus also between the piston rod and the reversing valve.

The advantages obtained by the invention reside particularly in the fact that the piston travels smoothly, in a strongly damped manner, to the position desired, and that also when the load changes the forces are balanced.

It is also possible to maintain the positioner device in the selected position even in the event of leaky lines between the reversing valve and the cylinder up to full piston power. Subsequently, after the unlocking of the locking device, the setting in motion proceeds smoothly in the original direction or, after an intervening reversal, in the opposite direction of movement.

It also proves particularly advantageous in that the locking elements of the locking device which engage the piston rod have to produce only little surface pressure, as it is necessary to shift only the reversing valve to the closing or blocking position. This results in a correspondingly long life.

BRIEF DESCRIPTION OF THE DRAWING

FIGS. 1-A and 1-B show one of the components of the stopping device in different positions than shown in FIG. 1.

DESCRIPTION AND OPERATION

Figure 1:
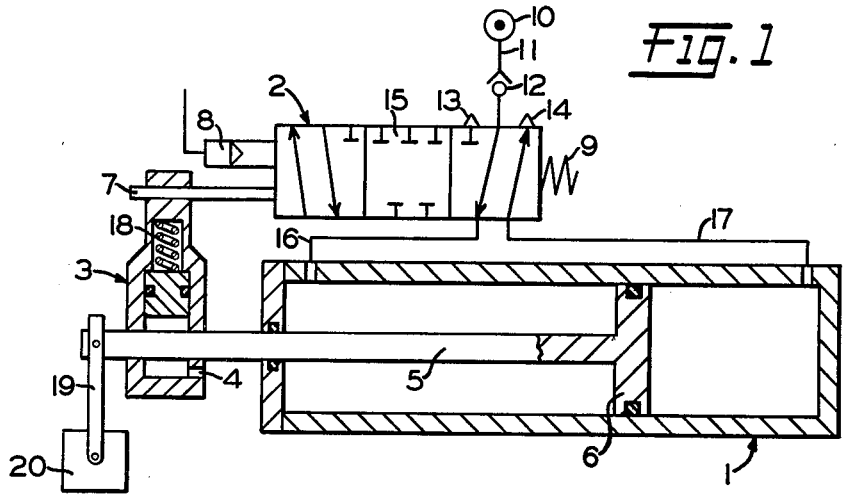
FIG. 1 of the drawing is a sectional view of a stopping device embodying the invention.
Figure 1A:
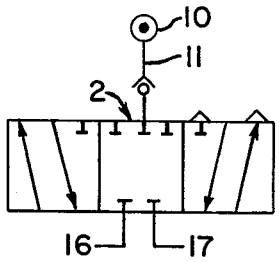
Figure 1B:
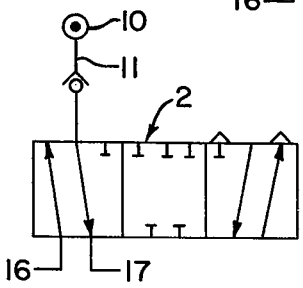

A positioner device embodying the invention comprises a double-acting operating cylinder 1, a reversing valve device 2 in the form of a non-lapping, three-position, two-way valve shown diagrammatically, and a locking device 3, which is provided with a compressed-air connection 4 and engages a piston rod 5 of a piston 6 which can be acted upon by compressed air on both sides.

Figure 2:
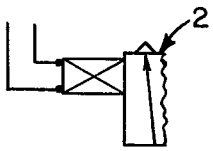
FIG. 2 shows a modification of the stopping device shown in FIG. 1.

The reversing valve device 2 is rigidly connected to the locking device 3 by means of an actuating stem 7 and is provided on the end adjacent said actuating stem with a reversing actuator 8 for operating the valve device 2 in a rightwardly direction, as viewed in the drawing, to the position shown in FIG. 1-B, in which the right side of piston 6 is subjected to pressure, and on the opposite end with a spring 9 for biasing the reversing valve device 2 in a leftwardly direction to the position shown in FIG. 1, in which the left side of said piston is subjected to pressure. The actuator 8 may be either pneumatically or electrically operable, the latter being shown in FIG. 2.

A source of fluid under pressure 10 is connected via a pipe 11 to a supply port of the reversing valve device 2, said pipe having a one-way check valve device 12 interposed therein and said reversing valve device being provided with two exhaust ports 13 and 14. The source of fluid under pressure 10 may also be connected to connection 4 of the locking device 3 and to actuator 8.

A central portion of the reversing valve device 2 is designed as a closing or blocking portion 15, which, when in a blocking position, as shown in FIG. 1-A, between pipe 11 and a pair of pipes 16 and 17 for communicating reversing valve device 2 to opposite sides of piston 6, blocks off all communication between said pipe 11 and pipes 16 and 17.

Locking device 3 is normally kept in the release position by means of compressed air supplied via the compressed-air connection 4, so that the position of piston 6 of operating cylinder 1 can be changed, while the position of the reversing valve device 2 may be shifted by supplying actuating pressure to actuator 8 by suitable means not shown.

When the compressed-air connection 4 is without air pressure, that is, when pressure is released from locking device 3, said locking device locks on the piston rod 5 under the influence of a spring 18. As a result of this coupling, the locking device 3 must follow (when pressure is supplied to the left side of piston 6), in an axial direction, the axial movement of the piston rod, thus causing valve device 2, through its coupling to stem 7, to be moved to the right relative to cylinder 1. Such movement also causes the blocking portion 15 of reversing valve device 2 to move rightwardly, and to reach its blocking position, above defined and as shown in FIG. 1-A, between cylinder 1 and the pressure source 10. When blocking portion 15 reaches its blocking position, pressure is cut off from the left side of piston 6 so that rightward movement thereof is terminated, said blocking portion being retained in said blocking position as long as no pressure is supplied to port 4.

In this manner, operating cylinder 1 is cut off from fluid pressure source 10, and, therefore, actuating pressure, so that piston 6 is brought to a rest position which position is thus maintained, because as long as the locking device 3 is locked on the piston rod 5, actuator 8 or spring 9 cannot effect further movement of reversing valve device 2. Thus, the position which the piston rod 5 and, therefore, the locking device 3 have reached at that moment, is very stable and is maintained with the full piston power.

The one-way check valve 12 in air conduit 11 serves the purpose of maintaining, in the event of a sudden air-pressure failure, the respective position reached as long as there remains pressure in the cylinder 1. Thereafter, the locking device 3 still keeps, in accordance with its holding force, the piston rod within the range of travel of the reversing valve device 2.

According to the position of piston rod 5, a lever 19 of a throttle valve device 20, for example, is accordingly positioned.

Having now described the invention what I claim as new and desire to secure by Letters Patent, is:

1. A positioner device for use with a double-acting, pneumatic operating cylinder having a piston and piston rod connectable to a member to be positioned thereby, characterized by a reversing valve device in the form of a non-lapping twoway valve for selectively communicating a source of pneumatic pressure with one side or the other of said piston and thereby determining the position thereof and of said member, said reversing valve device having a blocking portion effective, when in a blocking position, for blocking off communication between said source and said operating cylinder, and being fixedly attached to a locking device by means of an actuating rod, in which case the locking device, when subjected to pneumatic pressure, occupies a freely sliding relation with said piston rod and, when relieved of such pneumatic pressure, locks onto said piston rod, so as to provide, in the direction of axial movement, a coupling between the piston rod and the locking device and, thus, also between said piston rod and the reversing valve device.

2. A positioner device according to claim 1, wherein the reversing valve device is provided, on the end at which said actuating rod is fixedly attached thereto, with an independently operable actuating device effective, when subjected to pneumatic pressure, for axially moving said reversing valve device in one direction, and on the opposite end is provided with a spring which exerts permanent pressure on the reversing valve in a direction opposite to said one direction.

3. A positioner device according to claim 1, wherein said locking device is operable for joining the actuating rod of the reversing valve device to the piston rod in any operating position of the cylinder.

4. A positioner device according to claim 1, wherein the locking device is effective upon release of pneumatic pressure therefrom to lock the piston rod and piston in the axial position reached at that moment.

5. A positioner device according to claim 1, characterized in that a one-way check valve is interposed between said source and the operating cylinder for preventing reverse flow of pneumatic pressure from the cylinder to the source.

6. A positioner device according to claim 2, wherein the actuating device may be electrically operable.

* * * * *